US005621508A

United States Patent [19]

McNamara

[11] Patent Number: 5,621,508

[45] Date of Patent: Apr. 15, 1997

[54] REPLACEMENT SEAL FOR TONER HOPPER

[76] Inventor: Robert A. McNamara, 117 Electric Ave., Rochester, N.Y. 14617

[21] Appl. No.: 506,740

[22] Filed: Jul. 26, 1995

[51] Int. Cl.[6] ..... G03G 21/18; G03G 15/08

[52] U.S. Cl. ..... 399/106; 156/94

[58] Field of Search ..... 355/245, 260; 222/DIG. 1; 156/94; 229/205, 206

[56] References Cited

U.S. PATENT DOCUMENTS

| | | | |
|---|---|---|---|
| 4,862,210 | 8/1989 | Woolley | 355/245 |
| 5,110,646 | 5/1992 | Prestel et al. | 355/260 X |
| 5,177,540 | 1/1993 | Honda et al. | 355/260 |
| 5,446,525 | 8/1995 | Kobayashi | 355/210 |
| 5,523,828 | 6/1996 | De Kesel | 355/260 |

*Primary Examiner*—Joan H. Pendegrass

[57] ABSTRACT

An An apparatus for confining toner within a toner hopper aperture flange of a cartridge. The apparatus contains a frame which has a rigid plastic core, a first vertical end, and a second vertical end; the rigid plastic core has a central section with a rectangular slot disposed therein.

Adhesive material is located on each side of the plastic core. A strip is disposed over the central section of the frame and is adhesively joined to the frame. The strip has an end which extends over an end of the frame with enough length to fold back over the front of the frame and exit through the side of a cartridge, whereby the strip can be grasped and pulled out of the cartridge.

6 Claims, 7 Drawing Sheets

REPLACEMENT SEAL FOR TONER HOPPER

FIELD OF THE INVENTION

The invention pertains to replacement toner hopper seals to be used in remanufacturing used laser printer, plain paper fax, and copier cartridges. The cartridges are a developing apparatus for forming a permanent print and/or copy electrostatically with either a single component toner or a two component toner/developer. The two component toner/developer is well known from it's prolific use in electrostatic copiers. The single component magnetic toner has also found wide applications in Laser printers and plain paper fax machines. The term Laser in Laser Printers pertains to the latent image formation on the photoreceptor that is done with a computer driven Laser that writes only where the Laser impinges on the photoreceptor. Most commonly to date, the photoreceptor is charged with a net negative charge from either a high voltage corona or a conductive rubber roller with a high voltage charge on it. The energy from the laser is absorbed by the photogenerator layer of the photoreceptor. The photogenerator generates enough positive holes to bring the surface potential to zero. Since the toner has a net negative charge induced on it by the magnetic sleeve feed roller, it is repelled by the residual negative charge in the background areas, but, attracted to the laser written areas with a zero surface charge. In only a fraction of a revolution of the printer, the developed image on the photoreceptor is transferred to a sheet of paper that then goes through a fuser which melts the thermoplastic of the toner. The liquid plastic is absorbed onto and impregnated into the paper where it solidifies to form a permanent print. In the other system using laser exposure such as common in electrostatic copiers to date, the photoreceptor has a negative charge put on it by a high voltage corona. In this case the laser impinges only in the background areas where it generates a positive charge which decreases the surface potential only in background areas to perhaps less than 125 volts. The latent image is the remaining areas that still have charge left on them. The remaining image charge may be in the range of 600 to 800 volts. The toner in this case has a net positive charge on it and is attracted to the negatively charged areas. The positive charge on the toner may be inherent by the addition of positively charged "charge control agents" such as quaternary ammonium compounds. Here again the toner image is transferred to paper and fixed to it in a fuser.

In addition to lasers, many other light sources have in the past been successfully employed for exposure of photoreceptors and no doubt many of these machines are still in use.

BACKGROUND OF THE INVENTION

Recharging and/or remanufacturing used laser, fax, copier, etc. cartridges presents many anomalies never encountered by original equipment manufacturers since they build their equipment to run through only one cycle. Recycling is not an objective for their Engineers, i.e., it is not in their best financial interests.

Furthermore, due to the trend to build laser printers, plain paper fax machines and copiers more compact, predictable impediments to recycling (remanufacturing) certain cartridges have occurred. Such is the case with resealing a rectangular toner hopper transfer opening on a laser printer cartridge and it's sister plain paper fax cartridge. The hopper opening on these cartridges is recessed making it very difficult to install a new seal into it. A second impediment on these cartridges is an obstructed lower lip of the opening flange by a welded in spacer that covers about 76.5% of the lip, leaving only 23.5% available to mount the bottom of the seal to. The O.E.M. seal has apparently been installed before the spacer was ultrasonically welded in place since it is attached to the full bottom lip of the flange, i.e. also the part obstructed by the spacer. The third impediment is a restricted seal pullstrip exit port or slot that is only 0.25" wide.

Aftermarket seals may fall into three classifications, peel off seals, tear out seals, and hard card seals that slid into slots around the perimeter of the hopper opening effectively sealing the off the toner hopper.

Of these seals, the peel off and the tear out have been used for the above described cartridges with their impediments.

To overcome the first impediment, the recessed flange, seal makers use either a thick flat stiff seal baseplate or a thin flat seal and make it stiff by attaching a piece of cardboard to the front that is removed after it is in place. The thick seal baseplates are made to almost the exact width size and as a result there is less chance for the seal to be maligned. Thick seals of 0.020" or more have demonstrated that toner lumps build up on the thick edge and block the toner transfer through the slot in the seal baseplate. Thin seals of course do not have this problem, but, are much more prone to become maligned, crimped, and become bowed in the center if pressed too hard against the flange. A bowed seal may have a narrowed slot when the seal is pulled out.

The second impediment, not enough of the lower lip of the toner opening flange available to attach a seal to. Only approximately ¼ of the area available that the Original Equipment Manufacturer used to attach their seal to. Also, the original equipment manufacturer had a new clean plastic flange to attach a seal to unlike the remanufacturer that has to work with a used cartridge that is contaminated with toner residue and the remains of the O.E.M. seal and it's adhesive. The best designed current aftermarket seals that seal effectively, have a thick baseplate and a narrow slot. This design prevents the bottom of the seal from bowing up and over the limited exposed lower flange lip. These seals are made with only perhaps 0.005" to 0.010" tolerance for the overall width. Being very rigid it is much more difficult for these seal baseplates to ride up over the narrow bottom exposed flange lip. Also their rigidity tends to hold every segment of the bottom against the narrowed lower flange lip.

These seals are of the peel off type and were used successfully for perhaps a few years. Then something changed that resulted in insufficient toner transfer through the narrow baseplate slot. Unacceptable customer returns of remanufactured cartridges were experienced.

Thin seals are almost impossible to insert into the flange area and as a result one manufacturer of aftermarket seals in Belgium has marketed a thin fabric seal that tears out like the O.E.M. seal. This thin seal has a piece of cardboard stiffener attached to the front by a lower tact adhesive to aid in installation. This seal is still difficult to position. Even when they are in position the pressure required to effectively engage the high tact adhesive to the flange may dislodge the seal from the bottom or bow the seal. Since there is no rigidity to the seal itself, poor adhesion along the bottom lip will result in toner leakage. To further aggravate the situation, when the cardboard stiffener insertion aid is pulled off the seal, the force required to remove it may be enough to pull off or loosen the seal from the flange. This is highly possible even though the cardboard held to the seal with a low tact adhesive. The reason that can happen is the area of adhesion of the cardboard to the front of the seal is much greater than the area of adhesion on the back of the seal to the hopper flange. The area of adhesion of the low tact adhesive to the cardboard is about 2.3 times greater than the area of the high tact adhesive on the back of the seal to the flange. To even further exacerbate the problem, when the end of the cardboard is peeled off the front of the seal, it must be pulled up and out to avoid the front part of the trough for the magnetic roller section. Therefore, most of the resistance to the peel off force must come from the insufficient area of the lower flange lip. Attempting to reseal the loosened seal after removal of the installation tool could easily result in pushing it up over the bottom lip or crimping it. Thin seals are the worst choice for the inadequate and contaminated lower lip adhesive area.

The third impediment is the limited seal exit port or slot that restricts the seal width to only 0.25". Since the toner hopper transfer opening is 0.578" (wide including the flange) the seal assembly must be that wide. Obviously, the 0.25" seal that pulls out is not large enough to cover the total opening. This is accomplished with a cover or baseplate that stays in the cartridge after the seal has been pulled. The baseplate can be plastic or other material and has a slot in its central section for toner passage that the 0.25" seal covers up and/or seals. Since the seal is only 0.25" wide, the slot cannot be that wide. The seal must have enough overlap all the way around the perimeter of the slot to seal it. By common sealing techniques of glue, heat sealing or pressure sensitive adhesives, the overlap should be at least 1/16" (0.0625") all the way around. Subtracting this overlap from the width of 0.25", that is 0.25"–2(0.0625")=0.125" for the slot width. Therefore, necessary overlap reduces the effective toner transfer slot down about 0.125". This type of seal has worked well in the past as stated above, but, does not function well anymore. The slot is not wide enough to always transfer enough toner through it to the magnetic metering roller section. This may be due in part to formulation changes in the toner available to rechargers. The current toners tend to cake and/or form small lumps in more humid conditions which is possibly due to some hydrophilic component added to the toner. When the cover or seal baseplate is thick, about 0.020", toner piles up on it and blocks the narrow slot. Toner transport through the narrow slot very unpredictable. In addition, the rubber of the beater bars used to push the toner through the hopper transfer slot become fatigued after several recharging cycles. As a result the toner has a diminished force exerted on it that is not adequate to force it through a narrow slot. This is well stated in the March 1995 "Recharger Magazine", 4218 W. Charleston Blvd., Las Vegas, N.V. 89102. The article is titled "The LX Toner Starvation Phenomenon" by Dr. John Wyhof of Static Control Components, Inc., phone (919) 774 3808.

The other way to deal with toner starvation problems is to use tear out seals. The two basic types used are the O.E.M. fabric on new cartridges only and the perforated plastic film, paper, and metal foils. The O.E.M. patent is U.S. Pat. No. 4,931,838 "Developing Apparatus And Process Cartridge Having The Same". There is one O.E.M. type fabric tear out seal with a new adjuvant for installation into remanufactured cartridges. It is manufactured by CF Distributors of Belgium. The seal is mentioned above and utilizes a cardboard stiffener to aid in installation. The CF seal is advertised as having a patent applied for and that application may be under the name of Jon DeKesel. The original equipment manufacturers seal is not suitable for remanufactured cartridges due to the inaccessibility of the full lower lip of the flange and the recessed flange.

The only applicable patent for remanufacturing is U.S. Pat. No. 5,110,646, "Process And Materials For Reconditioning A Toner Cartridge". This patent utilizes a perforated tear out polypropylene film. This seal could work as far as the width of the slot is, but, polypropylene is a tough synthetic plastic film and would be hard to tear out unless it were perforated rigorously. The necessary perforations claimed by the patent do have many large holes in them for toner to leak out. Claim 4 of the patent calls for perforations from 50 to 72 cuts per inch. With standard perforations that means there are 0.013" cuts followed by 0.007" spaces (uncut paper) for the 50 cuts per inch and for the 72 cuts per inch there are 0.007" cuts followed by 0.007" spaces. Clearly, half the film is cut away with the 72 cuts per inch and more than half the film is cut away for the 50 cuts per inch. This might not be bad for some applications, but, toner particles are very fine and dense. Their size ranges from 7 (0.000275") microns to 12 microns (0.000472"). The density of single component toner is relatively high since it contains about 44% w/w magnetite or magnetic iron. Equating the smaller particle size of toner to the cuts of the 72 cuts per inch means the cuts are 25 times as large as the 7 micron size and the cuts of the 50 cuts per inch are 42 times as large as the smaller 7 micron size toner particles. This will of course allow for significant leakage not only the smaller toner particles, but, also leakage of the larger 12 micron size particles and larger. To further exacerbate the leakage problem, synthetic films are stressed during processing to improved physical properties. Once the stress is relieved by cutting, the edges of the cut will curl and no longer remain in the plane of the film. The cuts might appear as tiny funnels under magnification.

The other thin seal by CF Supplies of Belgium is a thin flat seal that is difficult to install and has all the problems as mentioned above under the second impediment. They are propensity to bow and lose adhesion to the contaminated limited lower lip of the flange, i.e. it is absurd to think that a thin aftermarket seal could securely be attached to only 23.5% of the lip without the other 67.5% that the O.E.M. engineered as necessary for their thin cloth seal.

It thus is an object of this invention to provide the folling devices and advantages:

a. to provide a seal assembly for resealing used laser printer, plain paper fax, and electrostatic copy cartridges for remanufacturing that will not leak toner.

b. to provide a thin, but, rigid seal assembly that can be installed easily onto a toner hopper opening flange that is in a recessed area.

c. to provide a seal assembly that utilizes an L shaped seal baseplate whereby the adhesive under said leg is used to securely attach the bottom of the seal assembly to the toner hopper. The said leg is securely attached to the spacer that is perpendicular to the lower lip of the flange that obstructs about 76.5% of it. The said leg more than compensates for the obstructed part of the flange in terms of bonding area and it is also more resistant to the force exerted on it by toner in the hopper. That is the resistance of the said leg's bond to the spacer is directly opposite the force exerted by toner in the hopper in transit. The bonds to the flange are perpendicular to the force exerted by the toner and therefore less resistant. In addition the bond of the said leg to the spacer prevents the bottom of the seal from being pushed up over the 23.5% of the exposed lower lip as happens with flat seals.

d. to provide a means whereby the bottom of the assemble's said leg can be slid so the assembly back can be positioned against the flange utilizing an adhesive release paper or other release material under the said leg's adhesive, then said release can be removed after seal assembly back is secured against the flange.

e. To provide toner transfer slot opening in the seal baseplate assembly that is consistently equal to or greater than the seal exit port slit opening.

f. To provide said toner baseplate slot opening 0.1875" wide up to 0.250" wide or greater to prevent toner starvation and/or white out sections or streaks in prints where there is no toner available to print the image.

g. to provide a 0.145" wide by 0.002" to 0.005" thick strong precision made pullstrip that is bonded to the back side of a natural precursor friable film seal. The said pullstrip forcible tears out the section of the film bonded to it in the film's direction of orientation and that is parallel to the toner hopper transfer slot opening. The said strong precision pullstrip assures that the resultant slot in the film seal will be consistently at least as wide as the said pullstrip.

h. To provide a natural precursor film seal from cellulose that tears preferentially along the direction of molecular orientation and therefore does not require any perforations to assure its tear out in a preferred direction. Without perforations the film is impervious to toner particles.

i. To provide an oriented natural precursor film seal material from cellulose that will not generate enough static that could be deleterious to the functioning of the printing as synthetic films could.

j. to provide said natural precursor film seal that will not generate static significant static and thereby holding toner by static attraction that blocks the transfer slot opening.

k. to provide a seal that effectively attaches to the toner hopper flange utilizing a 72 oz high tact pressure sensitive adhesive with a carrier. Said adhesive is a double sided tape with a thin plastic film in the center called a carrier. The adhesive has a tolerance for plastizers and other materials that may contaminate the adhesive bonding surface of the toner hopper and its flange, i.e. the adhesive will not loosen its bond to the surface due to the migration of contaminants into it.

l. to provide the same and/or equal tact adhesive on the front of the seal to securely hold the precision pullstrip to the front of the baseplate.

m. To provide an adhesive nulled or voided zone on the left edge of the front of the baseplate under the start of the peelback of the pullstrip starting at the left edge extending into at least 0.010" to 0.020" and it's height may be only a projection of the baseplate slot width or may run up to the total baseplate width. Said adhesive nulled zone is to prevent the adhesive's liner from pulling away from the front of the baseplate. The said adhesive nulled or voided zone is on the front side of the adhesive's carrier adjacent to the pullstrip and would be bonded to the pullstrip without said nulled or voided zone. That is the pullstrip is not secured with adhesive up to the edge of the baseplate on the start of the peelback side. Without this zone the propensity for the carrier to stay attached to the pullstrip may be equal to that for it to remain on the baseplate. In other words half of the time the pullstrip would delaminate the carrier from the baseplate and jam up in the exit port slit which would be a seal removal failure. Also it is possible to lift the whole baseplate from the toner hopper flange since that bond may not be quite as strong as the bond to the pullstrip due to contamination on the flange.

n. to provide a 0.005" thick layer or thicker layer of adhesive on the front of double sided adhesive's carrier on the front of the baseplate such that said adhesive layer is thicker than or equal to the pullstrip's thickness thereby embedding the pullstrip into said adhesive layer level with the pullstrips outer surface. With the outer surface of the pullstrip bonded to the cellulose film seal and the cellulose film overlapping the pullstrip bonded to the adhesive, the pullstrip is therefore totally encased so that toner cannot leak around it. That is the cellulose seal is bonded continuously over the baseplate opening and the pullstrip lengthwise over the baseplate's slot.

o. to provide a 0.005" thick or thicker layer of high tact adhesive with a carrier for uniform coverage on the front of the seal that holds the friable oriented cellulose seal firmly in place when the pullstrip tears out a section of it in the direction of the film's molecular orientation to form a toner transfer slot. Said thick layer of high tact adhesive holds the friable cellulose film securely in place and prevents it from delaminating from the baseplate instead of tearing out a swatch equal or greater in width than the pullstrip bonded under it.

p. to provide an adhesive release with a lip under the baseplate's leg and folded up parallel to the seal as a means of holding the seal assembly upright on the leg in the magnetic roller section when the hopper section is in upright position as per operating orientation in the machine. The seal assembly can then be held down to the floor in the section and then slid back against the toner hopper flange. This can be accomplished by hand or with a plastic spatula or other similar devices on the fold of the leg to the upright seal section of the seal assembly.

q. to provide a rigid seal assembly with a thickness of only of 0.005" to 0.015" plastic baseplate by utilizing a fold to enhance rigidity.

r. To provide a pullstrip uniform in thickness of 0.002" to 0.005" with a width of from approximately 0.145" to a limit of 0.250" and said pullstrip that guides a friable seal tear out accurately across the whole length of the baseplate slot.

s. To provide a seal film from cellulose a natural precursor that is dissolved and regenerated into a film. This natural based material does not generate deleterious amounts of static as does synthetic polymer films. This material is made by dissolving Cellulose in carbon disulfide in the presence of sodium hydroxide to form a viscous solution called viscose, in which the cellulose molecule has been degraded to an average chain length of 400 to 500 $C_6$ units. After ripening for eight days the viscose is extruded through a slot into a coagulating bath where the viscose is regenerated into a cellulose film called cellophane. The said film has a molecular orientation.

t. to provide a polyethylene terephthalate pullstrip that is strong enough to pull out a strip of Cellophane by tearing it along the direction of orientation of the molecules much the same way wood is split along its grains.

u. to provide a lower tact adhesive from approximately 32 once to 50 once tact on the front of the adhesive's carrier on the front of the baseplate. The said adhesive would always release the pullstrip and never delaminate the adhesive's carrier from the baseplate or pull the baseplate from the toner hopper flange. The said lower tact adhesive layer would be the layer of adhesive on the front side of the adhesive's carrier directly bonded to the pullstrip. There would be no need for an adhesive nulled zone at the start of the pullstrip's peelback. The bond between the pullstrip and the adhesive's carrier would be significantly less than the bond between the adhesive's carrier and the baseplate. The carrier would always stay bonded to the baseplate and never delaminate. The said lower tact adhesive would also be significantly less tact than the high 72 once tact adhesive on the back side of the baseplate, i.e. the adhesive on each side of the adhesive's carrier on the back side of the baseplate. Some moderate contamination of the flange bonding surface would therefore not weaken the bond of the baseplate enough for the pullstrip to pull the baseplate off the flange instead of tearing out the seal.

v. to provide a seal assembly with the slot torn out by the pullstrip can have it's bottom edge juxtapose to top edge of bottom lip of the toner hopper opening flange. The said slot would be effectively as low as possible and therefore facilitate the transfer of toner into the magnetic roller metering section. This could be important for hoppers that have been recycled many times and their rubber beater bars are fatigued and cannot place sufficient force on the toner to push it through a higher slot opening. The said slot can be that low since the bottom section of the baseplate is held in place by the leg of the seal to the spacer that is perpendicular to the plane of the flange. That is the center can be cut out of the baseplate and extend down to the horizontal leg with no vertical section necessary to butt against the exposed lower lip. There is no need to use the top of the lower lip to bond the seal to since the bottom of the seal is more firmly attached by the leg to the top of the spacer that is perpendicular to the flange's lower lip than if it were bonded only to the 23.5% of the lower lip of the flange. The seal film can be attached to the top of the leg and effectively seal the larger slot in the baseplate. The baseplate ends are the only parts that need to be formed or bent to a 90 degree angle to make the right angle leg off the body of the baseplate. The rigidity will be less without the fold all along the bottom of the baseplate. Extra rigidity can be can be obtained if necessary by using a thicker baseplate since the will be no vertical component on the bottom of the baseplate for toner to build up on.

w. to provide a seal assembly that does not require that the old lower half of the O.E.M. seal be left in place on the toner hopper flange. Though old seal is not needed to prevent the new seal from riding up over the narrow exposed lower lip of the toner hopper flange.

Further objects and advantages are a replacement seal assembly for remanufacturing that is easy to install, inexpensive to manufacture and can be reproduced in quantity with good quality. Still further objects and advantages will become apparent from a consideration from the ensuing description and drawings.

SUMMARY OF THE INVENTION

In accordance with this invention, there is provided a device that attaches to a toner hopper aperture flange of laser printer cartridges, plain paper fax cartridges, and copier cartridges and confines toner to said hopper during transit to customer whom activates said cartridge by pulling out a pullstrip that in turn pulls out a predetermined section of said device leaving a predetermined slot for toner transfer through.

The device of this invention contains a frame with a rigid plastic core of predetermined thickness, width and length that has a rectangular slot in the central part of it and has a adhesive on each side of said plastic core.

The device also contains a strip of strong plastic of predetermined thickness, width, and length positioned over the central section of said slot lengthwise and bonded to the vertical ends of said frame by said adhesive with a end of said strip extending over a predetermined end of said frame with enough length to fold back over the front of said frame and exit through the side of a cartridge whereby it can be grasped by hand and pulled out of said cartridge.

The device also contains a fragile film derived from a natural polymeric precursor that was dissolved and regenerated into said film and said film is stretched across and bonded to said frame with said adhesive, and bonded to the said plastic strip with a adhesive.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
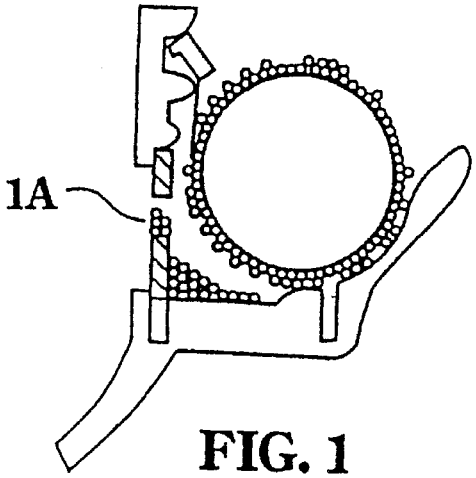
FIG. 1 PRIOR ART
FIG. 1 is a view of prior art cross section of the front of the toner hopper assembly with thick conventional seal baseplate and toner build up on it.

In the preferred embodiments illustrated in the aforementioned Figures, the reference numerals described below refer to the elements described below. 1A (toner build up on thick baseplate), 1B (toner build up between aftermarket and O.E.M. seals), 2 (exit port slot), 2B (magnetic roller felt bearing seal), 3 (toner hopper), 4A (seal assembly), 4B (release paper for under leg), 5 (toner hopper flange), 5A (upper lip of toner hopper flange), 5B (lower lip of toner hopper flange), 6 (adhesive on back and bottom of seal), 7 (seal assembly), 8 (seal pullstrip), 9 (seal film), 11 (prior art peel off seal), 12 (leg of seal), 14 (right angle of seal to leg), 15 (right angle left end), 16 (tear starting slits), 17 (top layer adhesive nulled zone), 17A (width of adhesive nulled zone), 18 (rectangle slot in baseplate), 20 (spacer floor of magnetic roller section perpendicular and juxtaposed to toner hopper flange), 22A (adhesive between seal and pullstrip), 23 (release plastic), 24 (adhesive carrier attached to pullstrip and seal film delaminated from plastic seal frame, 24A (adhesive), 24B (carrier film), 24C (adhesive), 26 (plastic baseplate frame or core), 33 (width of leg underside), 35 (width of paper to fold equal to leg underside), 35A (stop or fold in release paper), 37C (adhesive). 39 (beater bar to push toner through seal baseplate opening), 44 (toner magnetic feed roller), 59 (area adjacent to adhesive voided zone where pullstrip is attached to baseplate), 60 (area where pullstrip is attached to baseplate).

Figure 2:
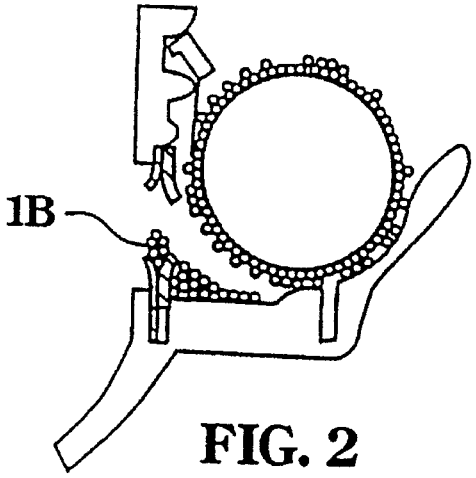
FIG. 2 PRIOR ART
FIG. 2 is another prior art cross sectional view of aftermarket seal baseplate affixed over remains of O.E.M. cloth seal and toner build up between them.
Figure 3:
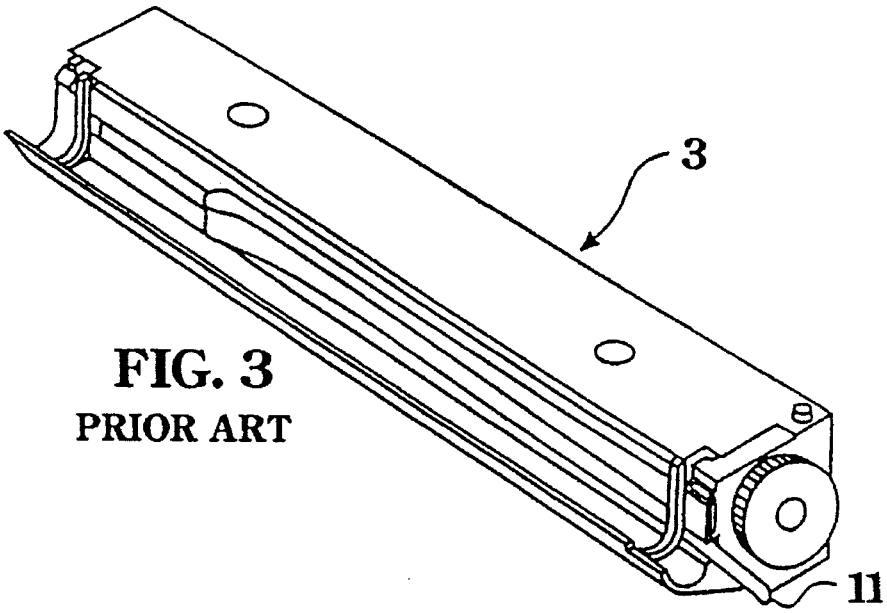
FIG. 3 PRIOR ART
FIG. 3 is a prior art view of toner hopper with a stick on seal assembly installed and partially peeled off narrower baseplate slot.

A typical embodiment for the seal of the present invention prior art is illustrated in FIG. 1 which has a thick baseplate with toner build up 1A that blocks the transfer slot. A similar situation occurs in FIG. 2 when the new seal installation utilizes the remainder of the old O.E.M. seal to bond to since the lower lip of the hopper flange is inadequate in bonding area. The space between the two allows for a toner build up 1B which blocks the transfer slot also. A stick on seal over the baseplate slot is shown in FIG. 3 where the slot has to be more narrow than the seal so that the seal can overlap and effectively cover the slot. The pullstrip 11 shows a partially peeled off seal in cartridge 3 prior art.

Figure 4:
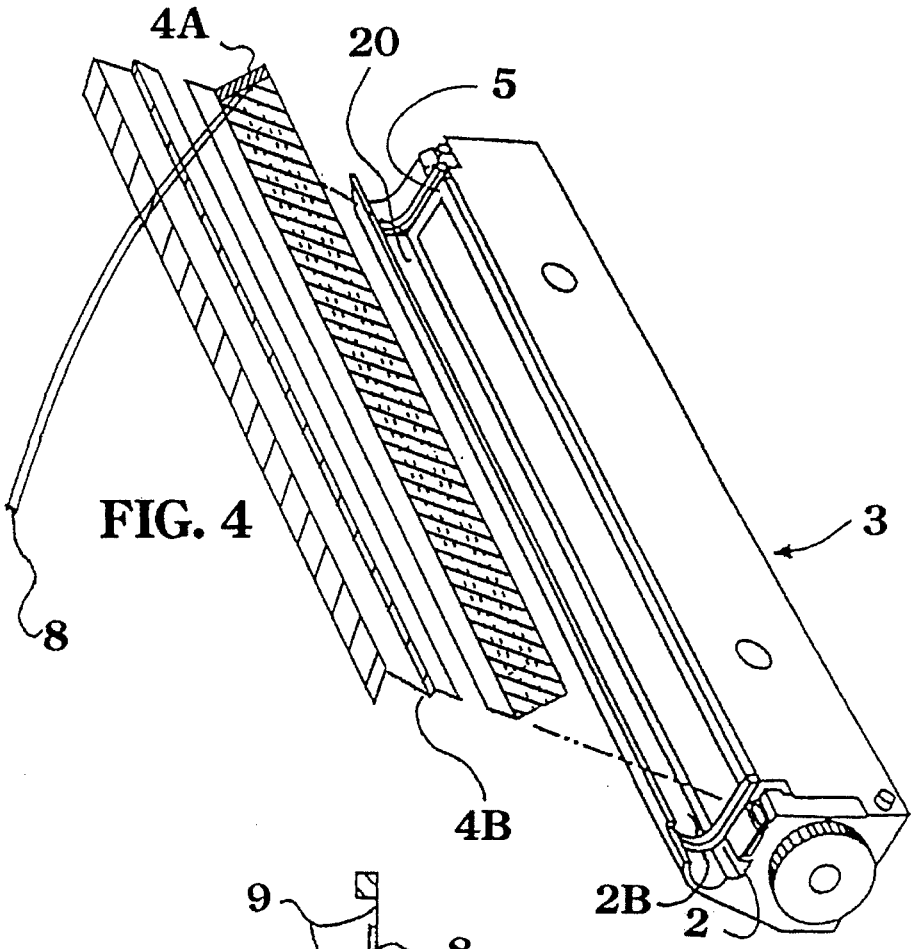
FIG. 4 is an assembled seal baseplate with release paper to go under the leg and directed where to be inserted into the toner hopper.
Figure 5:
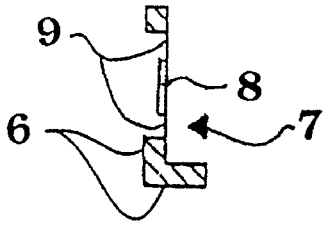
FIG. 5 is a cross-sectionional view of leg showing where adhesive is for attachment to hopper flange and perpendicular spacer.
Figure 6:
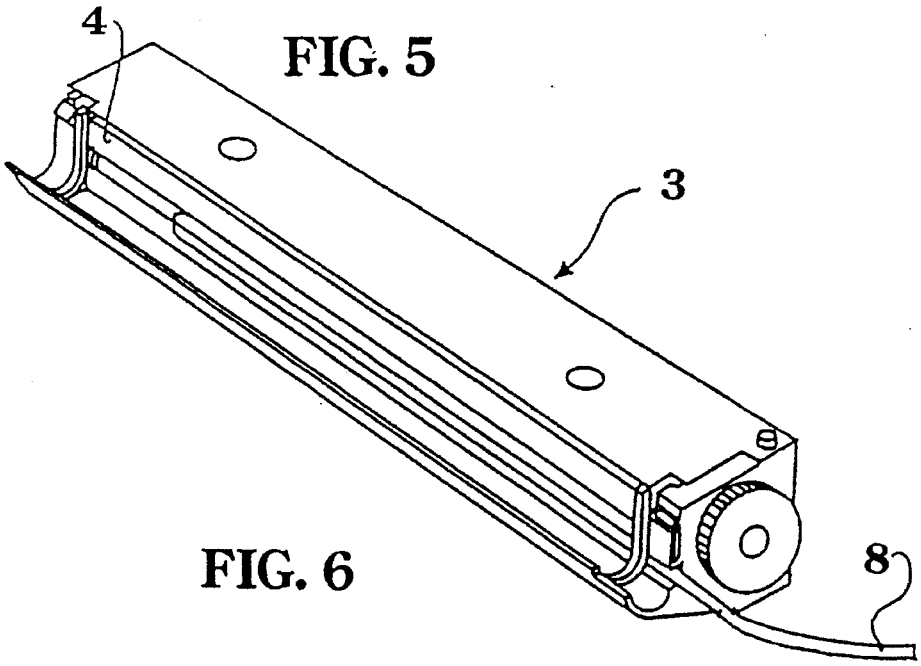
FIG. 6 is a view of a toner hopper with a partially torn out seal and the pullstrip out of the narrow exit slot.
Figure 7:
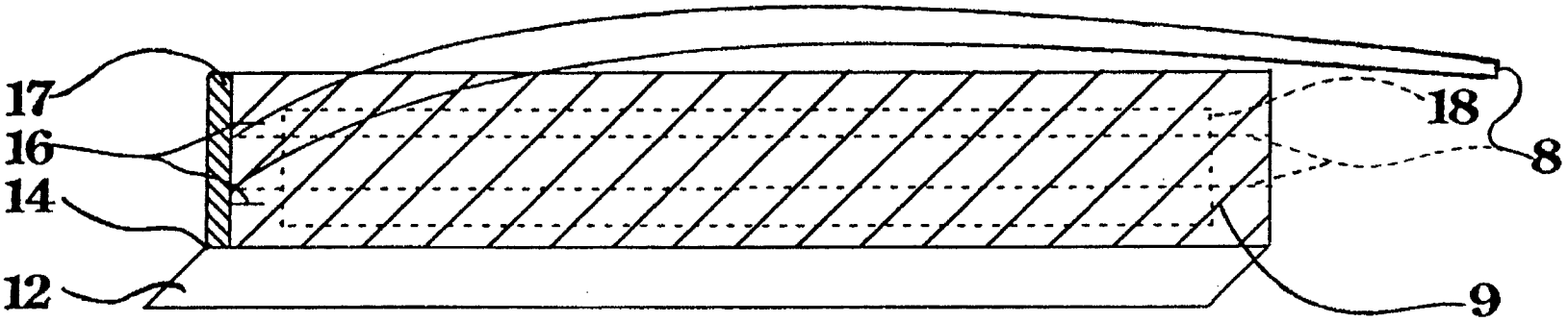
FIG. 7 is a view of a new seal assembly ready for installation.
Figure 9:
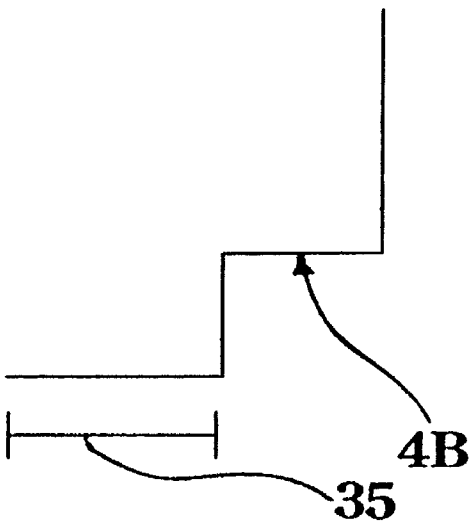
FIG. 9 is a cross-sectional view of folded release paper or other release material to fit under the seal leg.
Figure 8:
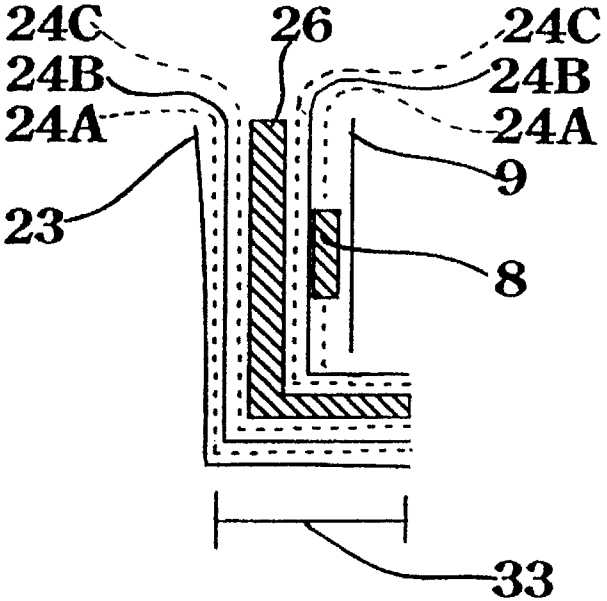
FIG. 8 is a cross-sectional view of the assembly of FIG. 7.
Figure 17:
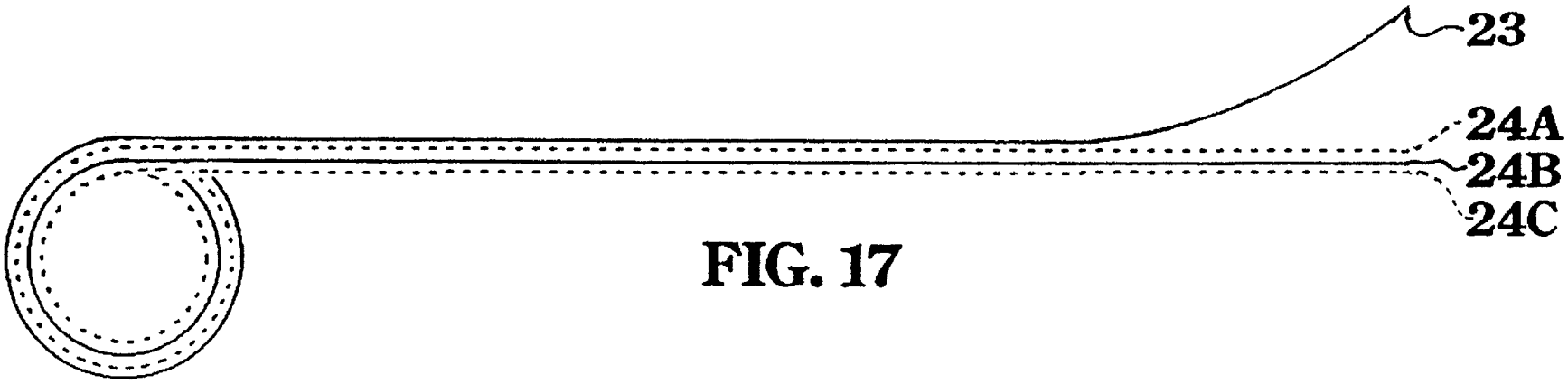
FIG. 17 is a cross section of a double sided adhesive roll.
Figure 18:
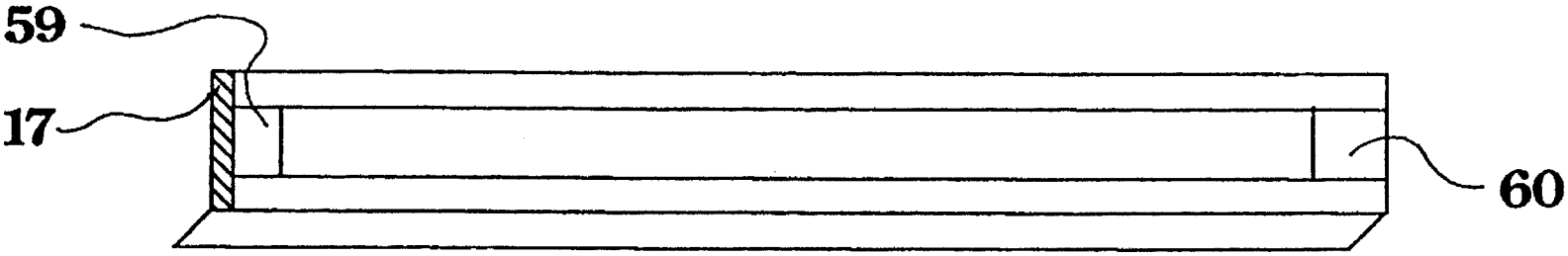
FIG. 18 is baseplate assembly without pullstrip or cellophane film seal.

A seal assembly 4A with a folded release paper 4B to fit under a leg so said seal leg can slide to allow said seal assembly to be positioned in place against the hopper flange 5 and bonded to it is illustrated in FIG. 4. A cross section of the seal 7 in FIG. 5 indicates where the adhesive 6 is to bond the seal into the cartridge, i.e. both on the back and under the leg. FIG. 5 also shows the pullstrip bonded to the back of the seal film 9. A new seal 4 is partially torn out in FIG. 6 of the cartridge 3 with the seal leader or pullstrip 8 coming out of the cartridge. A complete seal assembly is illustrated in FIG. 7 with a front view showing the leg or base 12 and its right angle intersection 14 with the vertical section. The slits in the cellophane film seal 16 are to start an even tear out. A voided adhesive zone 17 is to prevent delamination of the baseplate assembly when equal tact double sided adhesive with a carrier is desirable on the front of the baseplate, i.e. the tact of adhesive 24A is equal to the tact of adhesive 24C (FIG. 8) and also adhesives on the back of said seal assembly. Double sided adhesive 24A and 24C with a carrier 24B in FIG. 17 with release paper or plastic 23 as supplied from converters in rolls. The toner transfer rectangular slot 18 represented by dotted lines is cut through the plastic frame and the adhesive on both sides of it in FIG. 7. A baseplate assembly with double sided adhesive on both sides and anti-delamination zone 17 in FIG. 18 shows areas 59 and 60 where pullstrip will be attached to and then said cellophane seal 9 will be bonded over the front of both said pullstrip and said baseplate. Pullstrip 8 is attached on the front of the baseplate on each end and bonded to the backside of the cellophane seal film 9 indicated by hatch marks and covers everything on the front of seal assembly and may or may not cover the top of leg 12. The cross section end view of FIG. 8 shows a release plastic 23 that must be removed before installation of the seal. Double sided adhesives 24A and 24C on each side of carrier 24B is used to hold the seal to the cartridge hopper flange and the leg to the adjacent perpendicular floor spacer. The plastic baseplate frame 26 has double sided adhesive 24A, 24B, and 24C on the front side and the pullstrip 8 is attached to each end of the baseplate by adhesive 24A where it is imbedded in it. The cellophane seal 9 is bonded to adhesive 24A also and bonded by adhesive to the pullstrip 8 it covers. Leg width 33 is equal to the inside fold 35 of release paper 36 in FIG. 9 that is used to cover adhesive under the leg so that the seal assembly can be slid into place against the hopper flange.

Figure 10:
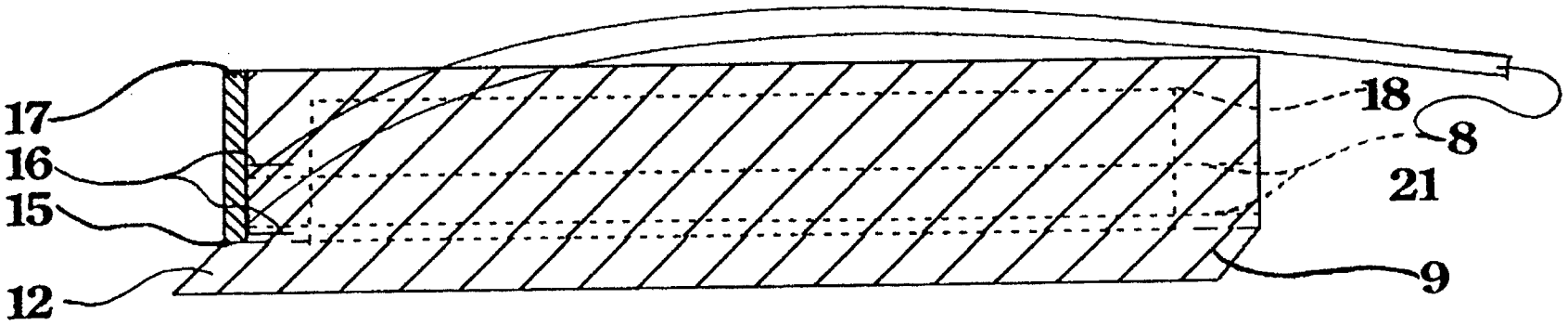
FIG. 10 is a view of a seal assembly with baseplate lower edge of cut out juxtaposed to upper side of leg.
Figure 12:
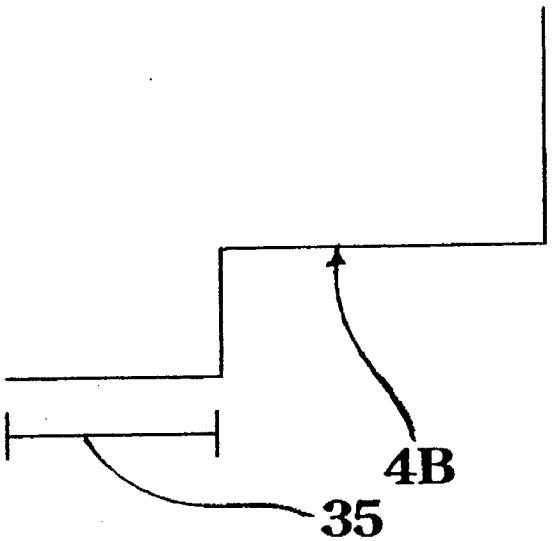
FIG. 12 is a cross-setional view of folded release paper.
Figure 11:
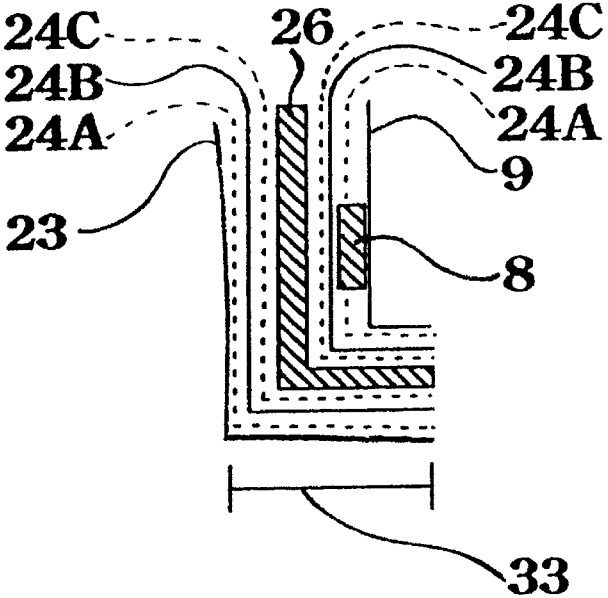
FIG. 11 is a cross-sectional view of the seal assembly of FIG. 10.
Figure 13:
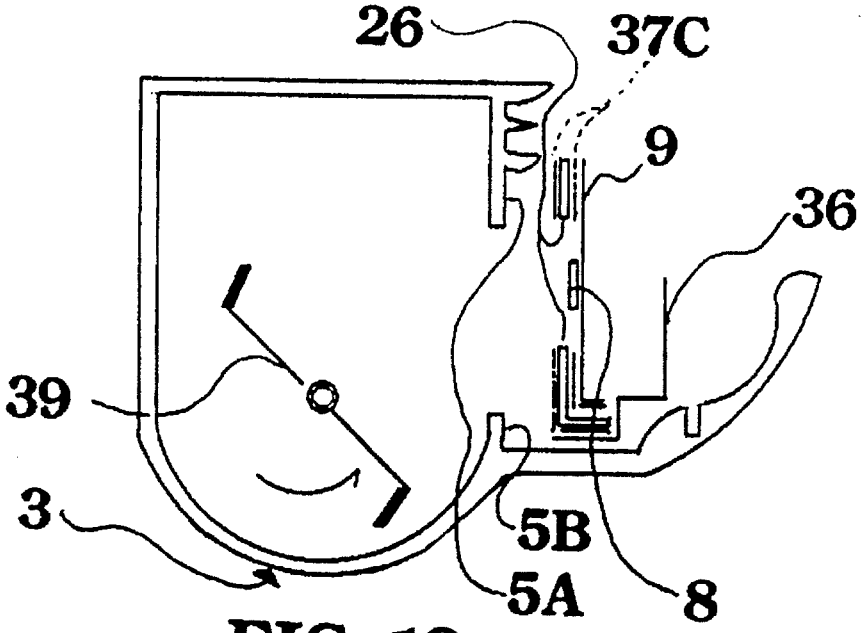
FIG. 13 is a cross section of central parts of disassembled toner hopper and seal assembly with release paper in position to slide into place against the toner hopper flange lips.
Figure 14:
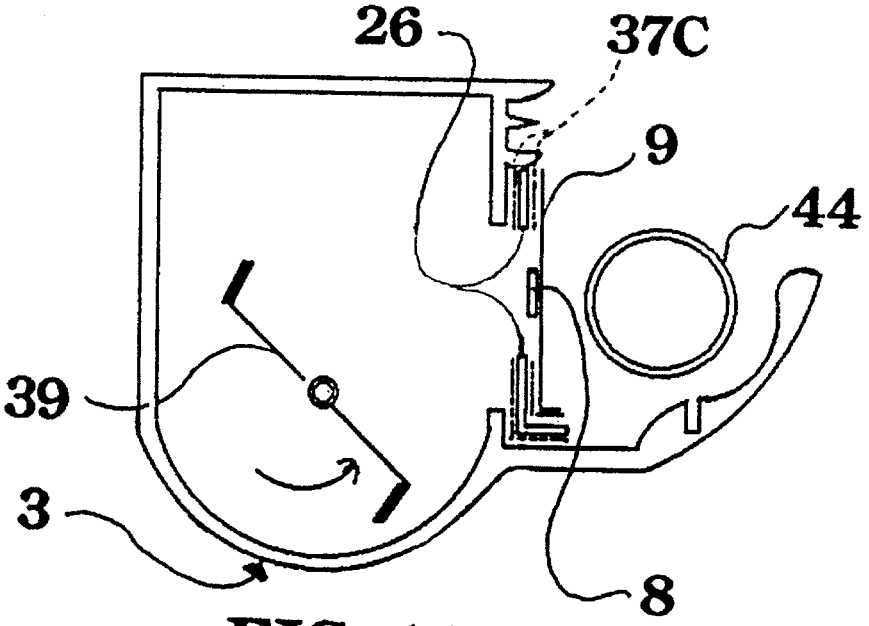
FIG. 14 is a cross-section of central parts of assembled toner hopper with new seal installed.
Figure 15:
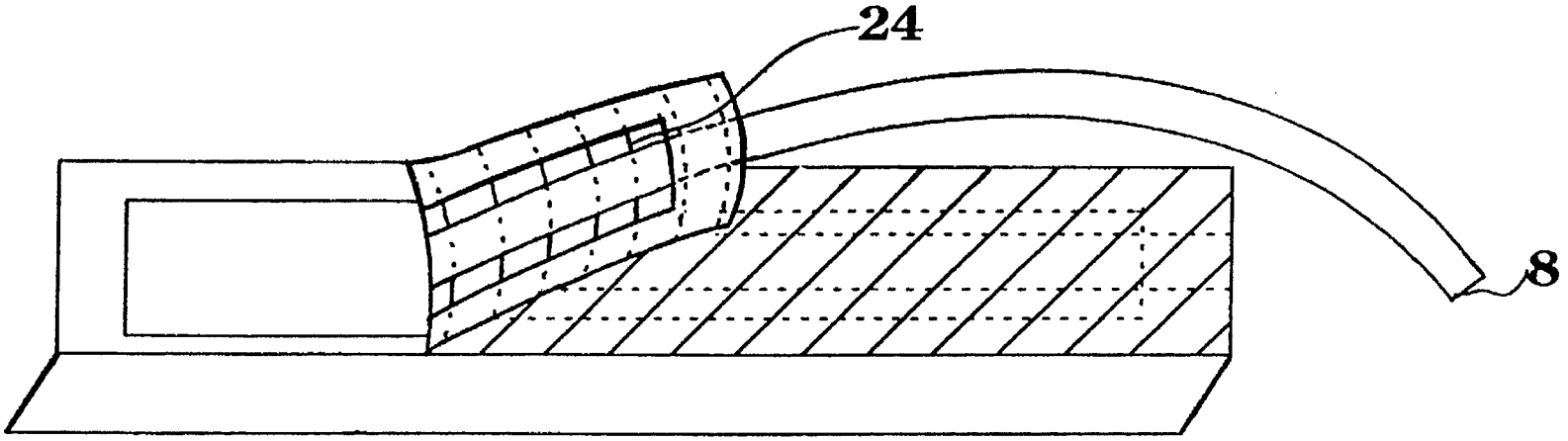
FIG. 15 illustrates delamination of adhesive from plastic frame.

An alternative embodiment is illustrated in FIG. 10, where the baseplate cutout 18 lower edge is juxtaposed to the top of the leg 12. Only the two ends, 15 on the left and 21 on the right, need to be formed into right angles making forming easier. The tearout cutting slits 16 are in the cellophane seal film 9 and the adhesive voided anti-delamination zone 17 are analogous to those depicted in FIG. 7 except that said seal film 9 must be attached to the top of leg 12. The rectangular baseplate cut out 18 indicated by dotted lines has no vertical section under it and therefore the seal can be torn out lower to facilitate transfer of toner through the slot. The makeup of the stack in FIG. 11 is the same as for FIG. 8 with the exception that the film seal 9 must cover the upper surface of the leg. The pullstrip 8 can be placed where it's lower edge is juxtaposed to the top of the leg if necessary to assure adequate transport of toner through the slot. The width of the leg 33 is equal to the inside fold 35 of the release paper 36 in FIG. 12. The release paper is placed under the adhesive under the leg so that it can slide into place where the adhesive on the back can contact the flange and bond to it by pressure from a plastic spatula or other suitable tool. A cross section cartridge 3 in FIG. 13 showing the toner beater bar 39 in the toner hopper and the only available 0.032" part of the lower flange lip 5B and the upper flange lip 5A that is adequate and over 0.100" larger than the lower lip. The seal assembly consists of the plastic frame 26 with adhesive on both sides 37C and the cellophane seal film 9 completely covering the front with a plastic pullstrip 8 bonded to the back of the cellophane seal film with an adhesive. The folded release paper 36 is under the leg so that it can slide on the horizontal floor spacer when the seal assembly is pushed into place against the flange. A preferred technique for sliding the seal into place is to push with a plastic spatula in the inside intersection between the leg and the vertical parts until the exposed adhesive on said seal assembly back is in contact with the flange. Bonding of the seal to the flange can then be accomplished by pressing on the perimeter of the seal against the flange. The bottom of the seal is then held against the bottom lip of the flange 5B with a spatula while the release paper is pulled out. The leg is then bonded to the floor spacer by pressing down on it. The loose end of the plastic pullstrip is folded back flat and fed through the exit port slot 2 in FIG. 4 and the retainer seal not shown is slid into the exit port holding the pullstrip in place. Also is filling of the hopper with toner and installation of doctor blades and magnetic roller 44 in FIG. 14 showing an installed seal. The adhesive 37C is bonded to the flange and the plastic frame 26 and also holds the cellophane seal film 9 to the front of the frame. The cellophane seal film has pullstrip 8 bonded to it's inside with adhesive. The magnetic feed roller assembly 44 is in place and toner hopper 3 can be filled with toner that will be pushed up through the slot in the seal film when the cartridge is activated at the customer's site by tearing out the seal. A possible adhesive carrier delamination 24 from the plastic frame is illustrated in FIG. 15 if the pullstrip 8 is bonded to the edge of said baseplate adhesive 24A. A center cross section (FIG. 16) with paper end cap anti-delamination zone 17 that is predetermined 17A wide prevents pullstrip 8 from bonding all the way to the edge so that it cannot lift up the adhesive 24A with carrier 24B and adhesive 24C from plastic frame 26. The adhesive area under 17A is enough to hold the adhesive 24C with carrier 24B against the pull of adhesive 24A bonded under said adjacent pullstrip 8 thus holding said carrier firmly to the plastic frame 26 i.e., to prevent delamination of said carrier 24B from said plastic frame 26 when the pullstrip is peeled off at the start of said seal tear out extrication from the cartridge.

The manner of using a fragile film of cellophane for a toner seal that is tearable along the direction of it's molecular orientation is discussed in this section. Since the film is too fragile to fashion into a tearable seal with a leader or pullstrip subtending off its central section, a special strip of a strong plastic P.E.T (polyethylene terephthalate) is bonded to the back of the seal in the designated central section where the toner slot is needed. Said pullstrip and said seal film are bonded to a plastic frame that is made to attach to a flange of the toner hopper opening of a cartridge.

Figure 16:
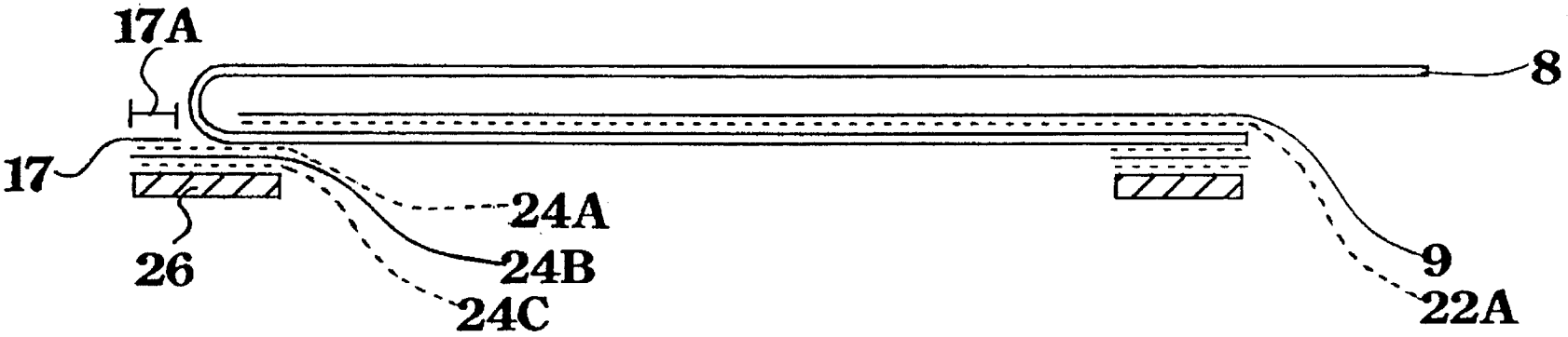
FIG. 16 is a center cross sectional view with anti-delamination paper covered zone.

In the preferred construction said pullstrip is from 0.001" to 0.005" thick PET by 0.25" (minus a tolerance) wide and 20.5" to 25" in length. The pullstrip 8 is stretched across a baseplate in FIG. 7 and attached to each vertical end section by adhesive on the baseplate. The baseplate is comprised of a rigid plastic core 26 in FIG. 8 cross section from 0.004" to 0.050" thick with high tact double sided adhesive 24A, 24B, 24C on the back and adhesive 24C, 24B, 24A on the front. The PET pullstrip 8 is embedded in the adhesive 24A on each end of the baseplate and said seal film 9 is bonded to said pullstrip 8 and also is bonded to the adhesive 24A on the front of the baseplate. In the event a cellophane adhesive tape is used for a seal film, no double sided adhesive is needed on the front of the baseplate save for adhesive in areas 58 and 60 in FIG. 18 for anchoring the pullstrip in place for assembly prior to installing the cellophane tape. Adhesive in areas 58 and 60 in FIG. 18 also prevents toner from leaking under said pullstrip and hold it securely thus preventing unwanted tearing of said seal film 9. A front view of the seal in FIG. 7 the pullstrip 8 is attached to each end of the baseplate and traverses through the central part to the rectangular slot 18 depicted by dotted lines in the baseplate. Said cellophane seal film depicted by hatch marks covers the rectangular opening 18 and also the pullstrip to which it is bonded by adhesive. There are starting slits 16 in the cellophane seal on each side of the pullstrip to facilitate the start of the tear out when the free end of the pullstrip 8 extending back over the front to the seal film 9 is pulled. A cross section of the seal's center section lengthwise FIG. 16 illustrates how when the pullstrip 8 is pulled it peels out said cellophane film 9 that is bonded in front to with adhesive 24A and it shows where the pullstrip is bonded to the baseplate ends with double sided adhesive 24A, 24B, and 24C. The double sided adhesive 24A, 24B, 24C is comprised of 0.005" adhesives 24A and 24C therefore adhesive 24A can seal the back and sides of pullstrip anchors on each end of the baseplate and the front of the pullstrip 8 is sealed with said cellophane tape's adhesive 22A in FIG. 16. As an alternate construction double sided adhesive can be applied to the pullstrip sheetstock before cutting into strips and the release stripped back far enough on the front of the strip so that the cellophane film can be bonded to it. The plain cellophane would then be bonded to the adhesive of said baseplate 26 on it's perimeter. Double sided adhesive can be used without or with a carrier 24B in FIG. 17 which is a thin plastic with adhesives 24A and 24C on each side and with a release paper or plastic 23 separating it in the roll as supplied from converters or tape companies. Since the pullstrip is in back of said seal film 9 in FIG. 7 it will always tear out a slot at least as wide as it is and sometimes larger of the seal film and therefore a tolerance of 1/16" is prudent to allow for enough clearance in the exit slot. With about this tolerance an extra 3/32" to 1/8" of seal film can be accommodated through the 1/4" pullstrip exit slot without jamming. The cellophane is merely crimped as it is all extracted with the pullstrip. The force required though slight to tear out the seal when the pullstrip is pulled demands that the baseplate be secured all around the toner hopper flange so that the baseplate will not be pulled off and touch the magnetic sleeve of the metering roller assembly and cause a printing defect.

To assure that this will not happen, applicant's seal has a leg 12 in FIG. 7 with adhesive under it to bond to the perpendicular floor spacer 20 in FIG. 4. Said floor spacer 20 (FIG. 4) obscures 76.5% of the lower lip of the hopper flange leaving an inadequate 23.5% for attaching a new seal to. That is only 0.032" available for resealing whereas the O.E.M. seal utilized the full bottom lip which is over 0.100" more and must have been installed prior to ultrasonically welding in said floor spacer.

Said floor spacer provides a good footing for a leg to be attached to, but, with the adhesive 24A, 24B, 24C exposed under said leg in FIG. 8 it is impossible to position a seal assembly into place against the toner hopper flange. To overcome this problem a folded release paper 4B in FIG. 4 is placed under the leg so said seal assembly can be slid into place. The width of adhesive 33 under said leg 12 in cross section FIG. 8 must be exactly the inside of the fold 35 in the cross section of release paper 4B in FIG. 9. A stop of plastic can be stapled to the release paper instead of a fold 35A to achieve the exact width. A width shorter than 33 in FIG. 8 would leave exposed adhesive that would inhibit sliding said seal assembly into place and a longer width would stop the seal short of flange. The installation of a seal assembly cross section 37B, 37C, 37D, 37E with release paper 36 is in position in cartridge 3 is illustrated in FIG. 13. Said seal assembly is ready to be pushed into position so that the adhesive 37C on the back of the seal will contact the hopper flange upper lip 5A and the lower lip 5B. Secure bonding can be accomplished by pressing the perimeter of the seal assembly when it is in position against the flange. The bottom of the seal must be held down and against the lower flange lip with a spatula or like while the release paper is pulled out. With the leg width of 0.125" the release paper can easily be pulled out. Once said release paper is removed said leg can be bonded to the spacer floor by pressing it down on it. The free end of said pullstrip 8 in FIG. 4 is then folded flat across the front of the seal and threaded under a felt bushing seal 2B for the magnetic roller and out the exit port slot 2. A spacer seal pullstrip retainer, not illustrated, is then slid into the exit port 2 in FIG. 4 to secure the pullstrip. The balance of the cartridge assembly is well known and published to the recharging industry such as installation of the Doctor blade and magnetic roller assembly, etc. A cross section of the seal assembly 26, 37C, 9, 8, in a cartridge 3 in FIG. 14 with magnetic roller assembly 44 and toner beater bar 39.

If the beater bar 39 in FIG. 14 is badly fatigued an alternate design seal assembly has a lower transfer slot to facilitate toner transfer. The opening in the baseplate 18 in FIG. 10 has its lower edge juxtaposed to the top of said leg 12. The lower edge of said pullstrip 8 may be lowered to the bottom of the slot 18 if required to accommodate more toner throughput.

For most installations, though, the slight part of the vertical section of the baseplate left in the cartridge will pose no problem to toner throughput. The bent baseplate affords a great degree of rigidity with a thin baseplate which makes installation easy. The thin baseplate eliminates said toner buildup problem 1A in FIG. 4. Also with the use of said leg to secure the seal to said floor spacer there is no need to leave the balance of the old O.E.M. seal in to mount the new seal to that can result in toner build up 1B in FIG. 4.

The use of a fragile film like cellophane for a seal film requires special consideration in engineering a seal assembly since it will not withstand rough handling during installation. Said pullstrip must be firmly secured to the tearout starting end to prevent premature seal tearing damage. Since said pullstrip is narrow, i.e. ¼" or less, it can easily be pulled off the tear starting end if handled roughly in a production environment that will of course result in propagation of a rip into said fragile cellophane film seal. To reduce chances of this from happening the pullstrip must be held firmly to the baseplate with high tact adhesive. The use of high tact adhesive under the pullstrip creates another problem, delamination of the adhesive with carrier 24 from the baseplate in FIG. 15. Another undesirable problem could be the removal of the whole baseplate assembly 4A from the toner hopper flange 5 in FIG. 4. This problem could arise from contaminants on the surface of the hopper flange from poor cleaning that weaken the adhesive bond. Poor adhesion of the baseplate to a toner hopper flange can also be the result of migration of excessive plasticizer from said cartridge flange into said adhesive thus weakening the adhesive bond. Many people have personally experienced said adhesion problem when sticking an adhesive label on a soft vinyl cover notebook that is loaded with plasticizer to make it soft and supple. The label will initially adhere to the notebook, but, after a short time, perhaps a day or more the label will fall off and will not stick back on again. The adhesive has lost it's tact due to the migration of oily plastizers into it.

To minimize the potential for dislodging said pullstrip with a false start during seal installation a high tact adhesive 24A under the pullstrip can be used equal in tact to the high tact adhesive 24C holding the adhesive carrier 24B to the plastic core 26 in FIG. 16 a lengthwise center cross section view. My device utilizes a tact free zone 17 of the adhesive layer 24A in the lengthwise cross sectional center view of said seal assembly FIG. 16. The tact free zone prevents said pullstrip 8 from being attached all the way to the edge. This gives the adhesive 24C more area 17A attached to the adhesive carrier 24B holding it firmly to the plastic baseplate core 26 than said pullstrip 8 has at the peel off/tear out start, i.e., the area of adhesion under said pullstrip 8 at the start with adhesive 24A can be thought of as having only one finite element of adhesion the width of the pullstrip as opposed to larger area 17A holding the end down securely. The tact free zone 17A can be from about 0.010" to 0.100" long and can be made by powder, oily liquids, waxes, etc. or covered with paper or other solid materials. Covering with a solid material such as paper is the preferred construction since any liquid or wax may migrate laterally and weaken and/or destroy the bond under the pullstrip.

An alternate construction would be to put a permanent fold in said pullstrip and place said fold adjacent to where the adhesive voided zone 17A is illustrated in FIG. 16. This would work satisfactorily except that production assembly workers may open up the fold and inadvertently let it touch and bond to said area 17A and that could result in delamination of the adhesive carrier. Another drawback to this construction is that it would require extra care to not place the pullstrip on to the edge over area 17A when assembling the seal.

Accordingly, it is apparent that the new seal fills requirements for resealing laser printer cartridges that have narrow seal pullstrip exit slots.

Also cartridges that were designed for throw away one cycle use, such as the Hewlet Packard 2 P and it's sister Cannon plain paper fax FX-1, have permanently ultrasonically welded in floor spacer members that obstruct most of the lower lip of the toner hopper transfer opening flange. That makes resealing tenuous and unpredictable with the current aftermarket seals.

The new seal utilizes said welded in floor spacer member that is juxtaposed and perpendicular to the hopper flange as an anchor point for the bottom of the seal. This is accomplished with the use of a right angle leg about ⅛" wide or less with adhesive under it for bonding to the perpendicular member.

To position the seal in place into the corner of the right angle between the flange and said member, an innovative tool was fashioned from adhesive release paper. Said release paper has either a fold or attached stop whereby it fits exactly under the adhesive under said leg so that a seal assembly can be slid back into position against said toner hopper flange. Once the seal is positioned and pressure bonded to the flange, the release paper can be pulled out while the seal's bottom is held against the flange with a spatula or similar tool. If the seal leg is much wider that ⅛" it may be difficult to remove the release paper. The seal leg is then pressure bonded to said floor spacer to finish securing the seal.

Another significant problem the new seal solves is a narrow toner transfer baseplate slot because of a narrow seal pullstrip exit slit. Typical aftermarket seal assemblies are comprised of a rigid plastic baseplate with a slot in it for toner transfer. The sealing member of this assembly is a strip of thin plastic that is bonded to the perimeter of the slot. Said strip of plastic must always be larger than said slot to cover it. Therefore common stick over said baseplate slot seals cannot have a baseplate slot that is as wide said pullstrip. Since said pullstrip seal member can only be a maximum of ¼" wide due to a limiting ¼" wide pullstrip exit slit the maximum said slot width can only be about ¼"–(2×1/16 overlap)=⅛" wide. Slots this width have been proven to be too narrow to feed sufficient toner to the magnetic feed roller. Another type of seal that is an O.E.M. clone type aftermarket only uses the narrow exposed part of the lower flange lip to attach the seal bottom to which is not sufficient. The O.E.M. seal is not available and could not be used since it requires the full bottom lip of the flange to attach to. Also these seals being cloth tend to leak toner.

The new seal utilizes a fragile film from a natural precursor, cellulose. The fragile film is formed by dissolving cellulose in carbon disulfide and regenerating it into a molecular oriented film, cellophane. The cellophane being too weak to fashion into a seal with a pullstrip subtending off the central part of it as the O.E.M. seal does, must have significant innovation to employ. In my seal, a strong strip of plastic such as PET is used to induce a total and complete tear out of a cellophane strip along it's direction of molecular orientation yielding a predetermined adequately wide toner transfer slot. Said pullstrip is either bonded to the cellophane by adhesive or cellophane adhesive tape can be used.

The pullstrip being only ¼" wide or less requires that a high tact adhesive be used to secure it to the baseplate. This is because even a false start tearout by rough handling during installation can propagate tears into said cellophane seal area and render it ineffective.

Utilizing top quality high tact double sided adhesive with a carrier is not usually possible, i.e. equal high tact adhesive on each side of the carrier. This is because there would be an equal chance that said adhesive carrier would stay attached to the pullstrip and jam up the seal extraction.

To overcome this problem an innovative device is used, a adhesive pacified zone in a adhesive layer bonded to said pullstrip and said adhesive carrier. This adhesive voided zone gives the adhesive under the carrier more bonding area from the outer baseplate edge into where said pullstrip overlap is attached, therefore, eliminating the chance for the adhesive carrier to stay attached to the pullstrip during seal extraction and jam it up.

While my description contains many specificities, these should not be construed as limitations on the scope of the invention, but, rather as an exemplification of one preferred embodiment thereof. Many other variations are possible. For example the pullstrip could be positioned on the front side of the cellophane seal with a strong bonding adhesive such as a heat seal adhesive. Another variation could be a right angle extension or overhang on the top of the seal assembly to add rigidity to the top. Still another variation might be making the baseplate core or frame by injection molding or casting. The frame could be made of a rigid plastic such as polystyrene or it's copolymers and or terpolymers, etc.

Still another variation might be one that has right angle tabs holding the bottom of the seal down to the perpendicular body juxtaposed to the flange bottom. Tabs work very well, but, precise forming of them into right angles to the seal section is critical. That is if part of the tab is left on the vertical part of the seal, the bottom edge would be raised accordingly and a decrease in the seal area to the limited lower lip would result. This would exacerbate an already tenuous limited adhesive area impediment. While the tabs, if not spaced too far apart would anchor the bottom of the seal against the lower bottom lower lip, tabs not formed completely in the horizontal direction would be deleterious to adequate sealing.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for anchoring the bottom of a seal assembly adapted to confine toner to the hopper of a cartridge comprised of a toner hopper transfer aperture flange, wherein:

(a) said apparatus comprises a leg attached to and extending from the bottom of said seal assembly, wherein adhesive is attached to at least a portion of said leg;

(b) an adhesive release of paper, plastic, or other material that has a fold or attached stop fashioned to fit exactly under said adhesive of said leg so that said seal assembly can be slid into place against said toner hopper transfer aperture flange and pressure bonded to it and said release can be pulled out from under said leg while the assembly bottom is held against said flange, and said leg can then be bonded to a cartridge body member by pressure.

2. The seal assembly as recited in claim 1, wherein said seal assembly comprises a frame comprising a rigid plastic core, and wherein said rigid plastic core is comprised of a central section and a rectangular slot disposed within said central section.

3. The apparatus as recited in claim 2, wherein said seal assembly further comprises a strip disposed over said central section of said rigid plastic core.

4. The apparatus as recited in claim 3, wherein said seal assembly further comprises a film consisting essentially of regenerated polymeric material, wherein said film is stretched across and adhesively bonded to said frame, and wherein said film is adhesively bonded to said strip.

5. The seal assembly as recited in claim 4, wherein:

(a) said seal assembly is comprised of an adhesive of equal high tact disposed on both sides of said frame adapted to hold said film firmly while said film is being torn to form a toner transfer slot;

(b) said strip consists essentially of a material selected from the group consisting of plastic, fiber, and metal; and (c) said strip is stretched across said central section of said slot in said frame lengthwise and is bonded to each short side of said frame by said adhesive, wherein one end of said strip overlaps a predetermined end of a short side, but is not bonded to the outer edge of said side with enough of said extended said strip to be folded back over the said frame and exit through an exist slit in a laser printer.

6. The apparatus as recited in claim 1, wherein said seal assembly is comprised of a cloth sealing device, and wherein said cloth is easily ripped in predictable directions.

* * * * *